United States Patent [19]

Shibuya et al.

[11] Patent Number: 5,076,706

[45] Date of Patent: Dec. 31, 1991

[54] METHOD OF MIXING OF DISPERSING PARTICLES WITH AN ELECTRODE ASSEMBLY

[75] Inventors: Akira Shibuya, Tokyo; Michio Aoyama, Kitakyushu; Isao Kimura, Tokyo, all of Japan

[73] Assignee: Koshin Denki Kogyo Co., Ltd., Tokyo, Japan

[21] Appl. No.: 605,903

[22] Filed: Oct. 30, 1990

Related U.S. Application Data

[62] Division of Ser. No. 252,248, Sep. 30, 1988, Pat. No. 4,988,208.

[30] Foreign Application Priority Data

Oct. 8, 1987 [JP] Japan ..... 62-252333
Mar. 30, 1988 [JP] Japan ..... 63-74565

[51] Int. Cl.[5] ..... B01F 13/04
[52] U.S. Cl. ..... 366/349; 366/127

[58] Field of Search ..... 366/127, 273, 274, 348, 366/349, 241

[56] References Cited

U.S. PATENT DOCUMENTS 3,452,973 7/1969 Kawawa et al. ..... 366/273

FOREIGN PATENT DOCUMENTS 3427344 1/1986 Fed. Rep. of Germany ..... 366/349
1164736 6/1989 Japan ..... 366/273
0609867 6/1978 U.S.S.R. ..... 366/127

*Primary Examiner*—Philip R. Coe
*Assistant Examiner*—James F. Hook
*Attorney, Agent, or Firm*—Dykema Gossett

[57] ABSTRACT

A method of and an apparatus for mixing or dispersing particles with use of gradient force produced by a contact type electric field curtain. The particles are mixed or dispersed by permitting them to be put in a dielectric container and pass through the action area of the electric field curtain.

3 Claims, 4 Drawing Sheets

METHOD OF MIXING OF DISPERSING PARTICLES WITH AN ELECTRODE ASSEMBLY

RELATED APPLICATIONS

This application is a divisional application of U.S. patent application Ser. No. 07/252,248 filed Sept. 30, 1988, now U.S. Pat. No. 4,988,208.

BACKGROUND OF THE INVENTION

1. Technical Field

This invention reltates to a method and an apparatus for mixing or dispersing particles based upon the principle of the contact type electric field curtain.

2. Background Art

A prior contact type electric field curtain is comprised of a train of electrodes and of a dielectric layer placed in close vicinity of or in contact with the electrodes, as disclosed in Japanese Patent Publication Kokoku No. 54-12667 "A method of constructing a contact type electric field curtain and an apparatus with use thereof. The electric field curtain is adapted in operation to permit a lightweight substance on the dielectric layer to have thereon electric charges induced by contact thereof with said electric layer and to be rendered to electrodynamical force afforded by the electric field curtain. The lightweight substance is hereby repelled and driven.

Referring FIG. 9, the situation described above is illustrated.

Electrodes a, which are rod-shaped or donut-shaped, for forming an electric field curtain are aligned, and spared from each other. Alternating voltage b is applied between the adjacent electrodes for forming alternating non-uniform electric field having electric force lines indicated by dotted lines c around the respective electrodes a. The alternating non-uniform electric field changes its magnitude and direction with respect to space, while with respect to time it changes its direction sinusoidally. As charged particles approach the alternating nonuniform electric field, the particles are under influence of alternating electric force along the line of electric force, c and hence are forced to oscillate substantially along the curved line of electric force c, whereby the charged particles are rendered to pulsating, outward centrifugal force which is perpendicular to the lines c each half period of the oscillation. Those particles are thus subjected to mean centrifugal force Fc.

Each particles is subjected, at a location close to the electrode a where the electric field is stronger, to the electric force oriented to go away from the electrode a while being subjected, at a location far from the electrode a where the electric field is weaker, to the electric force oriented toward the electrode a. This is because the particles oscillate in a viscous medium. Either way, as a result of difference therebetween, the particle is rendered to mean gradient force Fg directed along the line of electric force, c going away from the electrode a.

The mean centrifugal force Fc is produced owing to spatial change (curved configuration) of the direction of the electric force line c, while the gradient force Fg being produced owing to a spatial change of the density of the lines c (a gradient of electric field intensity). Both are produced because of the electric field being nonuniform and alternate. Thus, the particle is subjected to composite force formed thereof, i.e., electrodynamic replusion force Fr in the direction going away from the electrode train.

The particles adhering to the dielectric layer when the latter is taken into the electric field are charged immediately with electricity on the basis of the principle of the contact charge and forced to float from the dielectric layer owing to the aforementioned electrodynamical replusion force. Such a contact type electric field curtain apparatus finds its application in electrostatic precipitators, electrostatic coating booths, and electrostatic guns, where particles have to be swept off or moved by said repulsion force.

The present inventors have devised the present invention taking notice of a fact that any particle present in the action area of the electric field curtain is subjected to violent disturbance.

SUMMARY OF THE INVENTION

It is an object of the present invention to provide a method and an apparatus capable of mixing or dispersing particles electrodynamically.

Another object of the present invention is to provide a method and an apparatus capable of mixing or dispersing particles contained in a container.

Still another object of the present invention is to provide a method and an apparatus capable of mixing or dispersing particles contained in a layer by inserting or arranging an apparatus embodying the present method in the layer.

According to one aspect of the present invention, there is provided a method of mixing or dispersing particles contained in a dielectric vessel by arranging the vessel in the action area of an electric field curtain.

According to another aspect of the present invention, there is provided an apparatus including electrodes for forming an electric field curtain arranged to surround a dielectric container in which particles to be mixed or dispersed are contained, and a power supply for establishing an alternating electric field in the form of a standing wave or a traveling wave in the vicinity of the electrodes for forming the electric field curtain.

DESCRIPTION OF THE PREFERRED EMBODIMENTS

Figure 1:
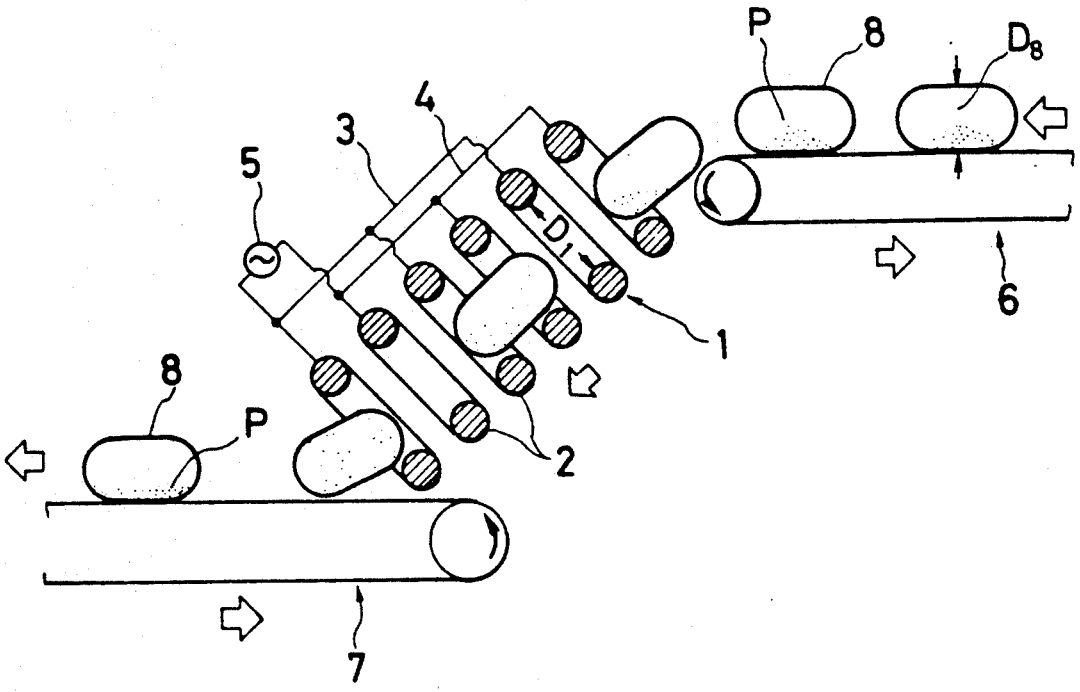
FIG. 1 is a front view in cross section illustrating an embodiment of the present invention.

Referring to FIG. 1, an embodiment of an apparatus for mixing or dispersing particles according to the present invention is illustrated.

An electrode assembly 1 for forming an electric field curtain is constructed like a cylinder by aligning with equal intervals a plurality of donut-shaped electrodes 2, each being insulated from another. It is to be noted that it is also satisfactory to attach the electrodes to an inner wall of a cylinder made of insulating material or to bury them in such a wall (not shown). The respective electrodes 2 of the electrode assembly 1 are alternately interconnected to conductors 3, 4, and connected to a single-phase or three-phase alternating power supply 5 of 4 to 15 kV and of a frequency ranging from 30 to 90 Hz. The electrode assembly 1 is slantingly arranged, with on the upper of which a carrying-in conveyor 6 being provided and on the lower of which a carrying-out conveyor 7 provided.

Meanwhile, particles p to be mixed or dispersed are put in a dielectric vessel 8 made of glass of plastic. The particles p may be a group of various kinds of powders to be mixed or cohered powders to be dispersed or materials in colloidal state, emulsion state or slurry state which have to be mixed or dispersed. The present invention finds its application, for example, in mixing of the main ingredient of medicine with additives, mixing of various chemical agent powders as well as of superconductor raw material powders as new application of fine ceramics, mixing of colorants of plastics for injection molding and mixing of reinforcement additives for said plastics, and mixing of wheat flour with a vitamin additive in a baking process, etc.

The present invention further finds other applications: uniform dispersion of powder particles cohered; and dispersion of particles in slurry, colloid, or emulsion in the vessel 8.

For the vessel 8, arbitrarily-shaped ones such as capsules, ampuls, reagent bottles, and test tubes may be employed. The vessel 8 has its outer diameter D8 smaller than the inner diameter D1 of the electrode assembly 1 such that it can pass through the inside of the electrode assembly 1. Now, operation of the illustrated embodiment will be described.

Figure 9:
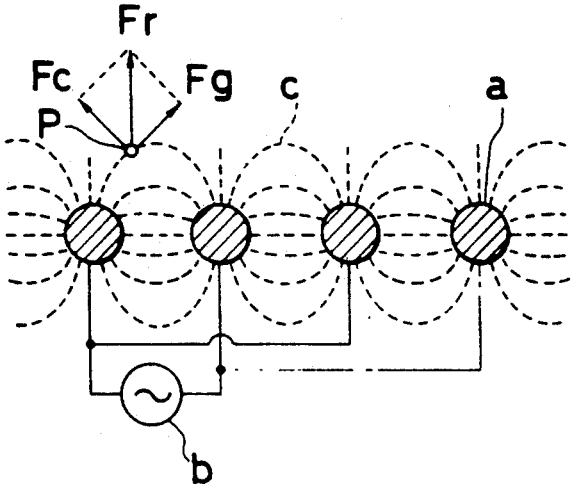
FIG. 9 is a view illustrating the principle of an electric field curtain.

Referring to FIG. 1, with application of single-phase high tension from the alternating single-phase power supply 5 to the respective electrodes 2 of the electrode assembly 1, an electric field curtain is established inside the electrode assembly 1, as illustrated in FIG. 9. Then, the container 8 containing therein the particles p to be mixed or dispersed is dropped into the electrode assembly 1 from the carrying-in conveyor 6. Hereby, the particles p in the vessel 8 are charged with electricity based upon the contact charge with the vessel 8 during the passage through the action area of the electric field curtain, and thereby disturbed. The particles p are thus mixed or disturbed completely before reaching the carrying-out conveyor 7. Such mixing or dispersing process is continuously performed by permitting many vessels 8 to pass in succession through the electrode assembly 1 by the carrying-in conveyor 6, as illustrated in the FIg. 1.

Figure 4:
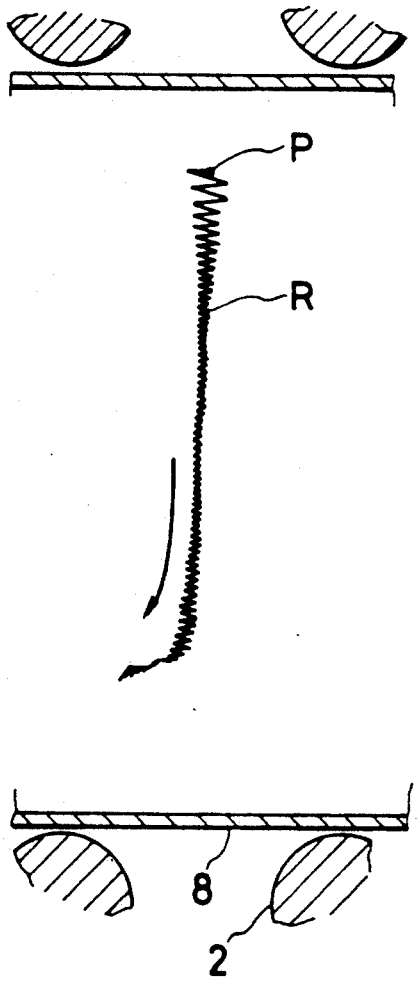
FIGS. 4 and 5 are views each illustrating the behavior of particles according to the present invention.

Referring to FIG. 4, behavior of the particles in the action area of the electric field curtain is illustrated. The adjacent electrodes 2 are supplied with alternating single-phase voltage of 14 kV. The particle p oscillates in the direction of the electric force line as shown by a trajectory R while moving downward in the direction indicated by the arrow in FIG. 4. Each particle p contained in the vessel 8 is disturbed in such a manner by being subjected to the electrodynamic force produced by the electric field curtain. Accordingly, any powder, which is contained in the vessel 8, can be uniformly mixed, or uniformly dispersed when aggregated.

Figure 5:
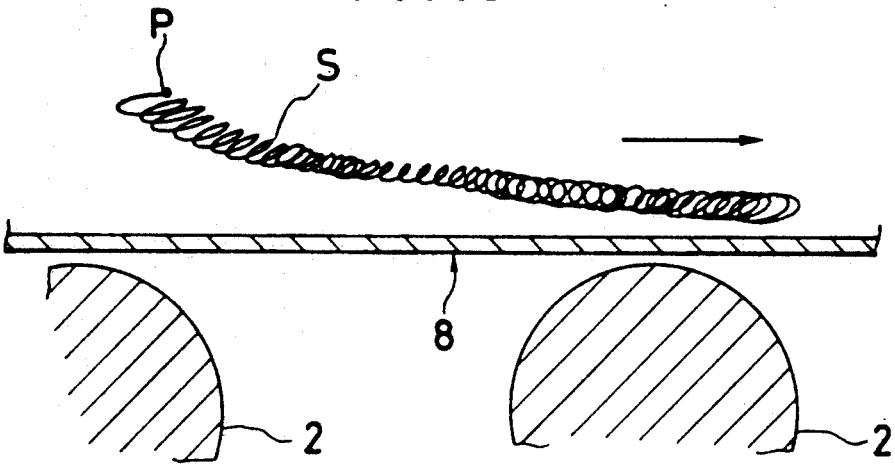

Here, when an alternating three-phase power supply is employed as the power supply 5, the electric field curtain travels as a traveling wave. That is, the particle p oscillates as indicated by S in FIG. 5, and travels in the direction the traveling wave moves as shown by the arrow. In case of the electrode assembly 1 of FIG. 1, the power supply 5 may be connected in a manner such that the traveling wave may be directed in a direction the container 8 falls or in another direction opposite thereto.

Figure 2:
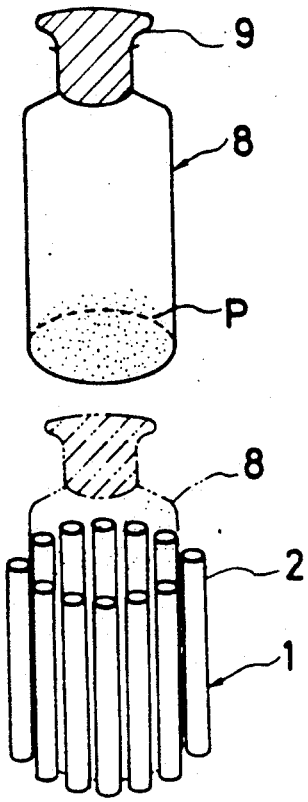
FIGS. 2 and 3 are perspective views each illustrating other embodiments of the present invention.
Figure 3:
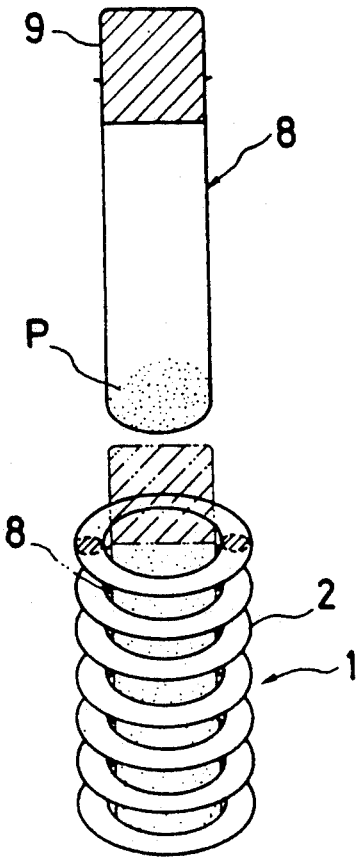

Referring now to FIGS. 2 and 3, other embodiments of the present invention are illustrated.

As illustrated in FIG. 2, an electrode assembly 1 consists of rod-shaped electrodes 2 arranged circularly in the form of a cage. The electrodes 2 are connected to an alternating single-phase or three-phase power supply (not shown). A reagent bottle is employed as a container 8 into which powder particles p to be mixed or dispersed are put after removal of a plug 9 and which is thereafter closed with the plug 9. The vessel 8 is placed inside the electrode assembly 1 as shown by the doubly-dotted chain line for mixing and dispersion of the particles p.

As illustrated in FIG. 3, an electrode assembly 1 is hollow cylinder-shaped, and a test tube is employed as a container 8. The test tube 8 accomodating particles p is closed with the plug 9 and inserted in the electrode assembly 1 so that the particles p may be mixed or dispersed.

Figure 6:
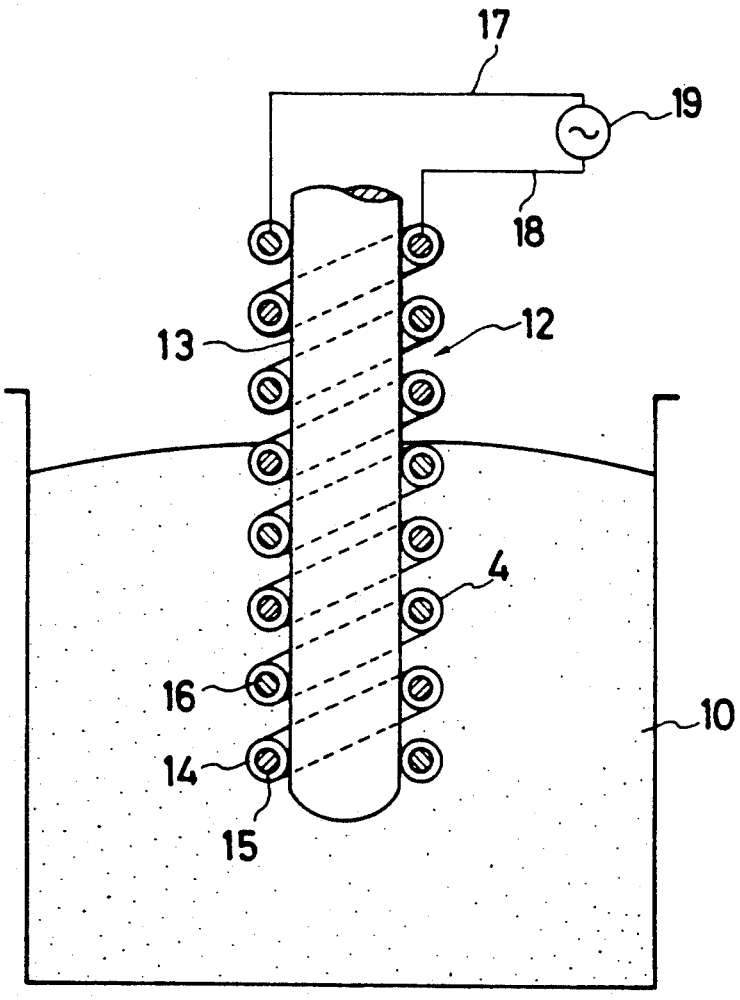
FIG. 6 is a front view in cross section illustrating further another embodiment of the present invention.
Figure 7:
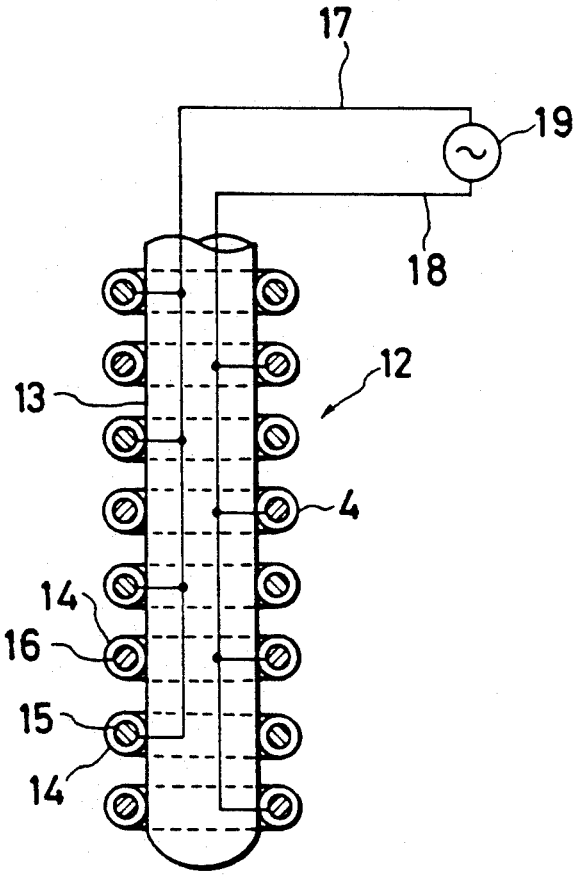
FIGS. 7 and 8 are veiws each illustrating an example of electrodes for forming an electric field curtain shown in FIG. 6.
Figure 8:
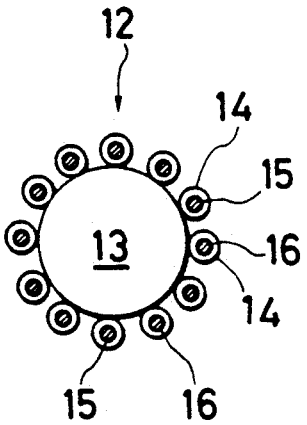

Referring further for FIGS. 6 to 8, yet other embodiments of the present invention are illustrated.

In FIG. 6, reference numeral 10 designates a particle layer to be mixed or dispersed. The particles layer 10 may be varieties of powders or powders in aggregation state or other materials such as colloid, emulsion or slurry. The present embodiment finds its application for example in mixing of the main pharmaceutical ingredient with additives, mixing of various chemical agent powders, mixing of superconductor raw material powders as new application of fine ceramics, mixing of colorants of plastics for injection molding, mixing of colorants of plastics for injection molding, mixing of reinforcement additives for said plastics, and mixing of wheat flour with vitamin additives in a baking process.

As for dispersion, the present embodiment finds its application in uniformly dispersing of powder particles aggregated in the particle layer 10 and in dispersing of liquid or solid particles in slurry, colloid, or emulsion.

An electrode assembly 12, which is coated with a dielectric, is comprised of an electrode supporter 13 made of an insulator such as a glass rod, and a pair of electrodes 15, 16 each electrode being coated with dielectrics 14 and helically wound around the outer periphery of the electrode supporter 13. Both electrodes 15, 16 are connected to a power supply 19 of for example an alternating single-phase via conductors 17, 18. The electrode assembly 12 may be adapted to include as shown in FIG. 7 circular ring-shaped electrodes 15, 16 instead of the helical ones 15, 16 shown in FIG. 6, which electrodes are connected to the power supply 19 via conductors 17, 18 provided in an electrode supporter 13, or adapted to include rod-shaped electrodes 15, 16 provided on the outer periphery of the electrode supporter 13 axially thereof as shown in FIG. 8.

Additionally, the dielectric-coated electrode assembly 12 may be constructed by forming the electrode support 13 with fine ceramics instead of mounting the electrodes 15, 16 coated with the dielectric 14 on the electrode supporter 13, and burying the electrodes 15, 16 in the electrode supporter 13 as the supporter is molded and then all of them are calcined together. For the power supply 19 an alternating three-phase power supply, which forms a traveling wave, may be employed other than the alternating single-phase power supply which forms a standing wave.

Operation of the embodiment described above is as follows.

First, application of the alternating single-phase power supply to the electrodes 15, 16 of the electrode assembly 12 causes formation of a non-uniform alternating electric field betgween the respective adjacent electrodes 15, 16. In this situation, insertion or pre-arrangement of the electrode assembly 12 into or in the particle layer 10 causes the particles in the particle layer 10 to be violently disturbed owing to the electrodynamical force exerted by the electric field curtain, whereby the particles in the particle layer 10 are mixed or dispersed. Here, mechanical movement of the electrode assembly 12 in the particle layer 10 assures more uniform mixing or dispersion of the particles in the particle layer 10. Arrangement of the electrode assembly 12 in the vicinity of the discharge outlet of a hopper for storing and discharging varieties of particles prevents stored particles from crosslinking, thereby assuring satisfactory discharge.

Although in the above embodiments with reference to FIGS. 1 to 8 the electrode assembly 1 was cylindrical, a flat plate type assembly or curved one may be employed.

Moreover, although for the power supply 15 the single-phase or three-phase one was employed, a DC power supply superposed on those power supplies may be employed.

Furthermore, although in the above embodiments the container 8 accomodating particles p was adapted to pass through the inside of the electrode assembly 1 or enter the interior of the electrode assembly 1, the electrode assembly 1 may be moved so as to apply the electric curtain to the container 8.

What is claimed is:

1. A method of mixing comprising the steps of:

introducing into a layer of particles to be mixed or dispersed a dielectric material-coated electrode assembly for forming an electric field curtain; and applying high voltage to said electrode assembly to mix or disperse the particles in said layer of particles by means of the electric field curtain.

2. A method of mixing particles according to claim 1, wherein said electrode assembly is formed by an electrode supporter and a plurality of electrodes coated with dielectric material, the electrodes being attached to said electrode supporter.

3. A method of mixing or dispersing particles according to claim 1, wherein the electrode assembly is located in the vicinity of a discharge outlet of a storage vessel for particles, so that discharge of the particles positioned in the vicinity of the the discharged outlet may be promoted.

* * * * *

UNITED STATES PATENT AND TRADEMARK OFFICE

CERTIFICATE OF CORRECTION

PATENT NO. : 5,076,706

DATED : December 31, 1991

INVENTOR(S) : Shibuya, et. al.

It is certified that error appears in the above-identified patent and that said Letters Patent is hereby corrected as shown below:

On the Title page, column 1, item [54] change the title to read "METHOD OF MIXING OR DISPERSING PARTICLES WITH AN ELECTRODE ASSEMBLY".

Signed and Sealed this

Twenty-third Day of March, 1993

*Attest:*

STEPHEN G. KUNIN

*Attesting Officer*

*Acting Commissioner of Patents and Trademarks*